US006619078B1

(12) United States Patent
Reese

(10) Patent No.: US 6,619,078 B1
(45) Date of Patent: Sep. 16, 2003

(54) BARREL LOCK

(75) Inventor: Mark H. Reese, Waukesha, WI (US)

(73) Assignee: Life-Long Locks, Inc., Germantown, WI (US)

( * ) Notice: Subject to any disclaimer, the term of this patent is extended or adjusted under 35 U.S.C. 154(b) by 0 days.

(21) Appl. No.: 09/735,289

(22) Filed: Dec. 7, 2000

Related U.S. Application Data

(63) Continuation of application No. 09/118,964, filed on Jul. 20, 1998, now abandoned.

(51) Int. Cl.[7] ..... E05B 67/36
(52) U.S. Cl. ..... 70/34; 70/386
(58) Field of Search ..... 70/32–34, 386

(56) References Cited

U.S. PATENT DOCUMENTS 3,186,196 A * 6/1965 Moberg ..... 70/386 X
4,015,456 A * 4/1977 Moberg ..... 70/34
4,252,006 A * 2/1981 Swisher ..... 70/34
4,394,820 A * 7/1983 Swisher ..... 70/34
4,426,860 A * 1/1984 Swisher ..... 70/34
4,441,343 A * 4/1984 Nielsen et al. ..... 70/34
4,543,807 A * 10/1985 Swisher ..... 70/34
4,614,097 A * 9/1986 Signorelli ..... 70/34
4,711,106 A * 12/1987 Johnson ..... 70/34
4,712,395 A * 12/1987 Agbay ..... 70/34
4,840,049 A * 6/1989 Russo ..... 70/34
4,946,130 A * 8/1990 Kooiman ..... 70/386 X
5,027,624 A * 7/1991 Agbay et al. ..... 70/34
5,050,413 A * 9/1991 Stillwagon et al. ..... 70/386
5,127,244 A * 7/1992 Myers ..... 70/34 X
5,410,893 A * 5/1995 Easterwood ..... 70/34 X
5,442,941 A * 8/1995 Kahonen et al. ..... 70/34
5,542,273 A * 8/1996 Bednarz ..... 70/34
5,664,445 A * 9/1997 Chang ..... 70/34

* cited by examiner

*Primary Examiner*—Suzanne Dino Barrett
(74) *Attorney, Agent, or Firm*—Boyle Frederickson Newholm Stein & Gratz S.C.

(57) ABSTRACT

A barrel lock for locking two structures together that includes two lock portions, each portion being generally cylindrical and elongated, one of which is substantially solid and one of which is substantially hollow. The first lock portion has one section of a substantially greater diameter than a second section, the two sections being separated by a beveled annular shoulder. The smaller diameter section is provided with a cylindrical axial aperture into which are disposed a plurality of spheres adapted to be received in apertures in the first portion of the lock, and also adapted for engagement in an annular groove on the interior surface of the second portion of the lock, the locking balls thereby effectively locking the two portions of the lock together. The second portion is axially aligned with the first portion and is provided with a keyway adapted for movement in a rotatable and axially slideable fashion within said second portion. The second portion is provided with a longitudinal and a cylindrical groove in its inner cylindrical surface, the grooves adapted for receiving a detent mounted on the exterior cylindrical surface of the keyway, the grooves intersecting at one point to permit axial and rotational movement of the detent within the grooves

6 Claims, 3 Drawing Sheets

BARREL LOCK

RELATED APPLICATIONS

This application is a continuation of application Ser. No. 09/118,964 filed on Jul. 20, 1998 now abandoned.

BACKGROUND OF THE INVENTION

The present invention relates to barrel locks and more specifically to an improved barrel lock assembly which is superior in its resistance to theft.

Various types of padlocks and barrel locks have been invented and patented in the past in an attempt to thwart the theft of trailers and other items coupled to automobiles or other vehicles. All of them were of some help but none were totally resistant to attempts to break them. Also various such locks have been used in connection with chains or cables to secure bicycles and other items against theft. The weak link in barrel locks is found in the keyway and detent operating structure within the lock.

A fairly comprehensive history of the background of security locks in general and barrel locks in particular may be found in U.S. Pat. No. 4,711,106 issued to Johnson and reference may be made to that patent for further history and background of the invention.

SUMMARY OF THE INVENTION

An object of the present invention is to provide a barrel lock structure which has a pair of generally cylindrically shaped lock body portions, one elongated and generally solid, the other short and generally hollow, and a means for axially locking the two portions together. The means for locking the two portions together includes a spring biased lock structure assembled in one portion of the lock that is movable axially relative to the other portion. The spring biased lock structure includes an axial extension that penetrates the first portion and for spreading a plurality of locking balls apart from each other and thereby lock the two portions together. The spring biased lock structure further includes a detent for engaging a shoulder provided in the first portion.

It is another object of the present invention to provide in a barrel lock structure of the character described above a generally solid cylindrical lock portion which has two sections, the first at one end being of a relatively larger diameter and thereby functioning like a handle or hand gripping portion which may be either smooth or knurled as desired.

It is yet another object of the present invention to provide structure of the character above described wherein the remainder of the first portion is elongated and separated from the first section by a generally conical shoulder and is of a lesser diameter than the first section and than the other lock portion, and the terminus portion of said second section remote from the first section is provided with a machined out cylindrical passageway.

It is yet another object of the present invention to provide in one portion of a barrel lock a plurality of locking balls radially disposed relative to each other, and in the other portion of the barrel lock a corresponding plurality of locking ball apertures adapted to receive a portion of the spherical surface of said balls, the balls being selectively moveable into the apertures, thereby providing a means for locking the first portion to the second portion.

It is still a further object of the present invention to provide structure of the character above described wherein the spheres or balls are movable between one disposition wherein their surfaces can touch and a second position wherein their surfaces are pressed partially into the ball apertures and their cylindrical surfaces cannot touch each other, thereby providing a means for locking the first portion to the second portion.

It is again a further object of the present invention to provide structure of the character above described wherein the second lock portion is of generally the same external cylindrical dimension as the first section of the first portion and there is coaxially disposed within the hollow interior an axially moveable piston, the piston having a stepped shape that includes an axial extension terminating in a conical plunger pointed outwardly away from the main body portion of the axially movable plunger. On the opposite end of the piston, remote from the conical plunger, is a keyway adapted to receive a key of a selected variety.

It is an even further object of the present invention to provide in a barrel lock of the character above described a spring biasing means for biasing the axially moveable piston in one direction away from the locking balls. Additionally, the spring biasing means is supple enough to be overcome by axial force manually imposed in the opposite axial direction to compress the spring and thereby force the axially moveable piston in the opposite axial direction, and to to hold the piston in a desired position to engage the detent when said keyway mechanism is rotated cylindrically.

It is an even further object of the present invention to provide in a barrel lock of the character above described an annular groove in the second section of the first portion and a snap-ring inner cylindrical sleeve in the cylinder aperture adapted to mate when the pointer plunger is placed maximally within the said cylinder aperture.

Other objects and advantages of the invention will become apparent from the following description which sets forth, by way of illustration and example, certain preferred embodiments of the present invention.

BRIEF DESCRIPTION OF THE DRAWINGS

The drawings, which constitute a part of the specification and illustrate an exemplary embodiment of the present invention, include the following.

DESCRIPTION OF THE PREFERRED EMBODIMENTS

Figure 1:
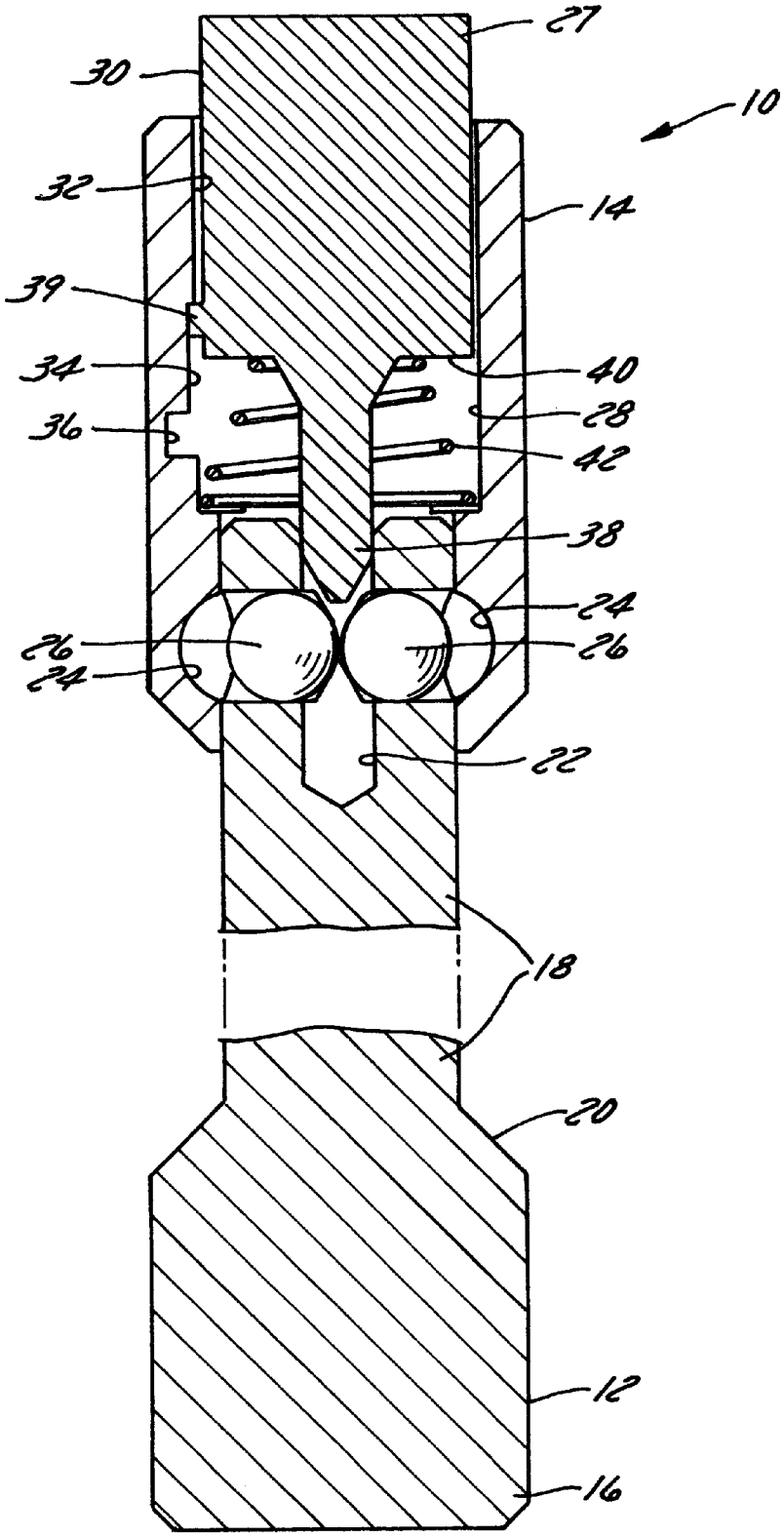
FIG. 1 is a vertical cross-sectional view of the barrel lock of the present invention illustrating the lock in the unsecured condition.

Referring now to the drawings and in particular to FIG. 1 thereof, there is shown a barrel lock assembly structure generally identified by the numeral 10. Structure 10 includes two axially aligned body portions, first body portion 12 and second body portion 14. First body portion 12 is generally elongated and solid, having a first section at one end identified by the numeral 16 and being of the greatest diameter in cross-section through body portion 12, and a second section 18 generally elongated relative to section 16 and being separated therefrom by a beveled shoulder 20 gradually stepping down the diameter between the two sections 16 and 18 while retaining the greatest strength possible. Sections 16 and 18 are in axial alignment with each other.

Second section 18 at the end remote from beveled shoulder 20 is provided with a central coaxial cylindrical aperture 22 open at the end of section 18 remote from section 16 and shoulder 20. Aperture 22 includes a radial passageway that extend across the width of section 18, and disposed internally of the radial passageway are a number of locking balls 26, the balls being spheres that are smooth surfaced and of a diameter such that when they are in place in the cylindrical aperture 22 they touch each other and are unable to escape the aperture 22.

Referring again to FIG. 1 of the drawings, second body portion 14 is seen also as being in axial alignment with first body portion 12. Second body portion 14 is generally hollow and includes internal passageway 28. The second body portion 14 includes an open end for receiving the second portion 18 of the first body portion 12. Machined into the internal surface of second body portion 14, at a location substantially adjacent to the open end thereof, are a plurality of locking ball apertures 24 that extend radially from the centerline axis of the lock. The locking ball apertures 24 are sufficiently large to permit the locking balls 26 to partially enter the apertures 24.

Second body portion 14 further includes, at the end remote from portion 12, a journaled keyway lock 27, which closes off one end of portion 14 and passageway 28. The internal surface of passageway 28 is machined smooth to receive for rotational movement keyway lock 27. The keyway lock 27 rotates about the longitudinal centerline axis of second body portion 14. Keyway lock 27 is also machined smooth on its outer cylindrical surface 30 so that it may slide smoothly axially and rotationally relative to the inner cylindrical surface 32 of body portion 14.

Inner surface 32 of body portion 14 is further provided with a first machined slot 34 that extends slightly radially outwardly with respect to surface 32. A second machined slot 36 is disposed adjacent to and slightly radially outwardly relative to slot 34. The outer surface 30 of keyway lock 27 is provided with a detent 39 adapted to fit within slots 34 and 36. Slot 34 provides for travel of the keyway lock 27 axially and longitudinally within passageway 28. Upon reaching slot 36, the keyway lock 27 may be rotated within passageway 28 the limit of slot 36.

Figure 2:
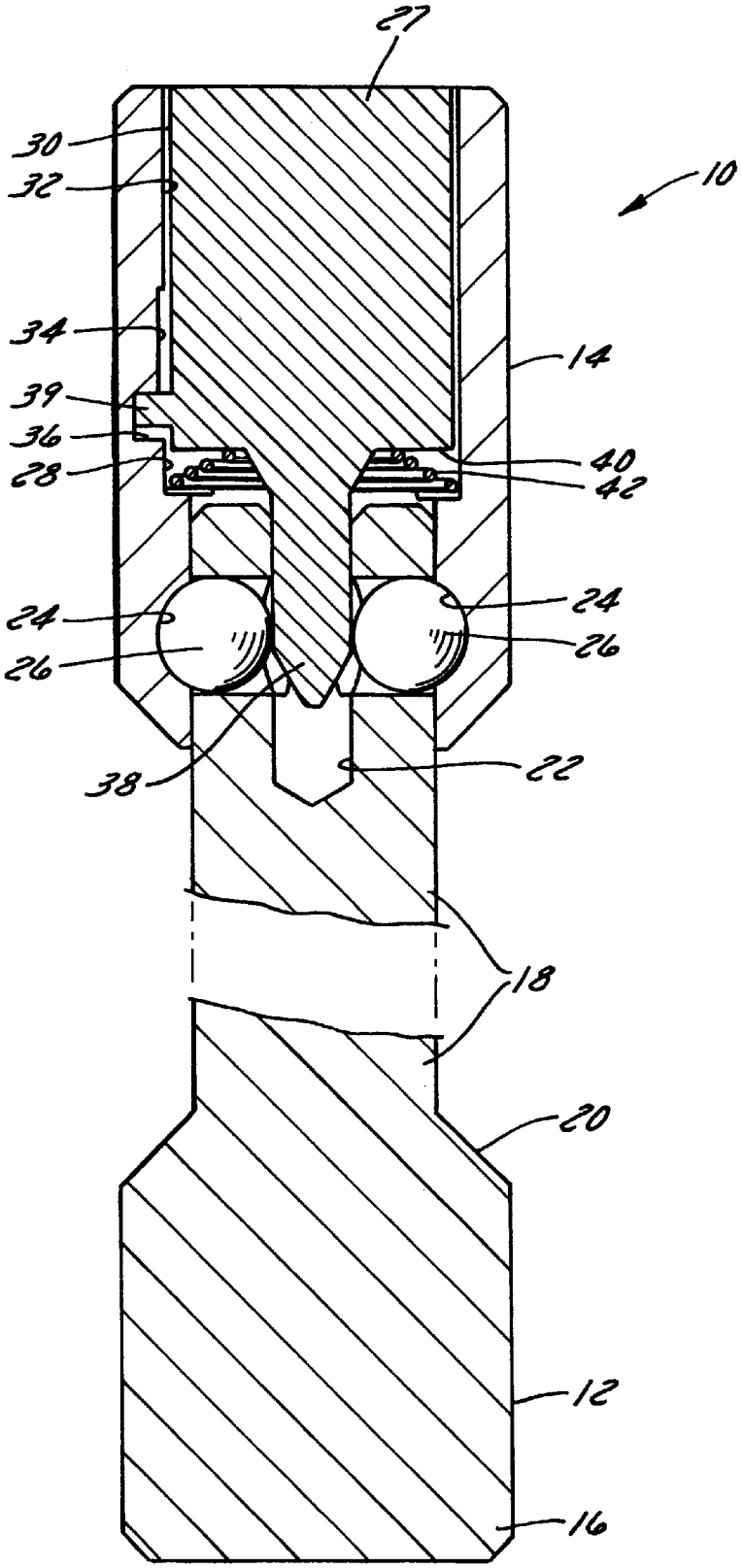
FIG. 2 is a similar vertical cross-sectional view of the barrel lock of the present invention illustrating the lock in the secured condition.

Keyway lock 27 is provided with an axially elongated extension protruding axially from one end of lock 27 and terminating in a bevel to a point 38. This, of course creates a shoulder 40 at the juncture of pointed extension 38 and the body of keyway lock 27. A coil spring 42 surrounds pointed extension 38 between shoulder 40 of keyway lock 27 and the end of extreme end of the second section 18 of the first body portion 12. Therefore, when the keyway lock 27 is manually moved axially toward body portion 12, the pointed extension 38 of keyway lock 27 enters the cylindrical aperture 22 of first body portion 12 and the spring 42 becomes compressed between shoulder 40 and the extreme end of second section 18 of first body portion 12. At the same time, the beveled point of extension 38 spreads locking balls 26 radially apart from each other and forces their external spherical surfaces into locking ball apertures 24. A reference to FIG. 2 of the drawings illustrates the positioning of all the described structure when the assembly 10 is in the locked position.

Figure 3:
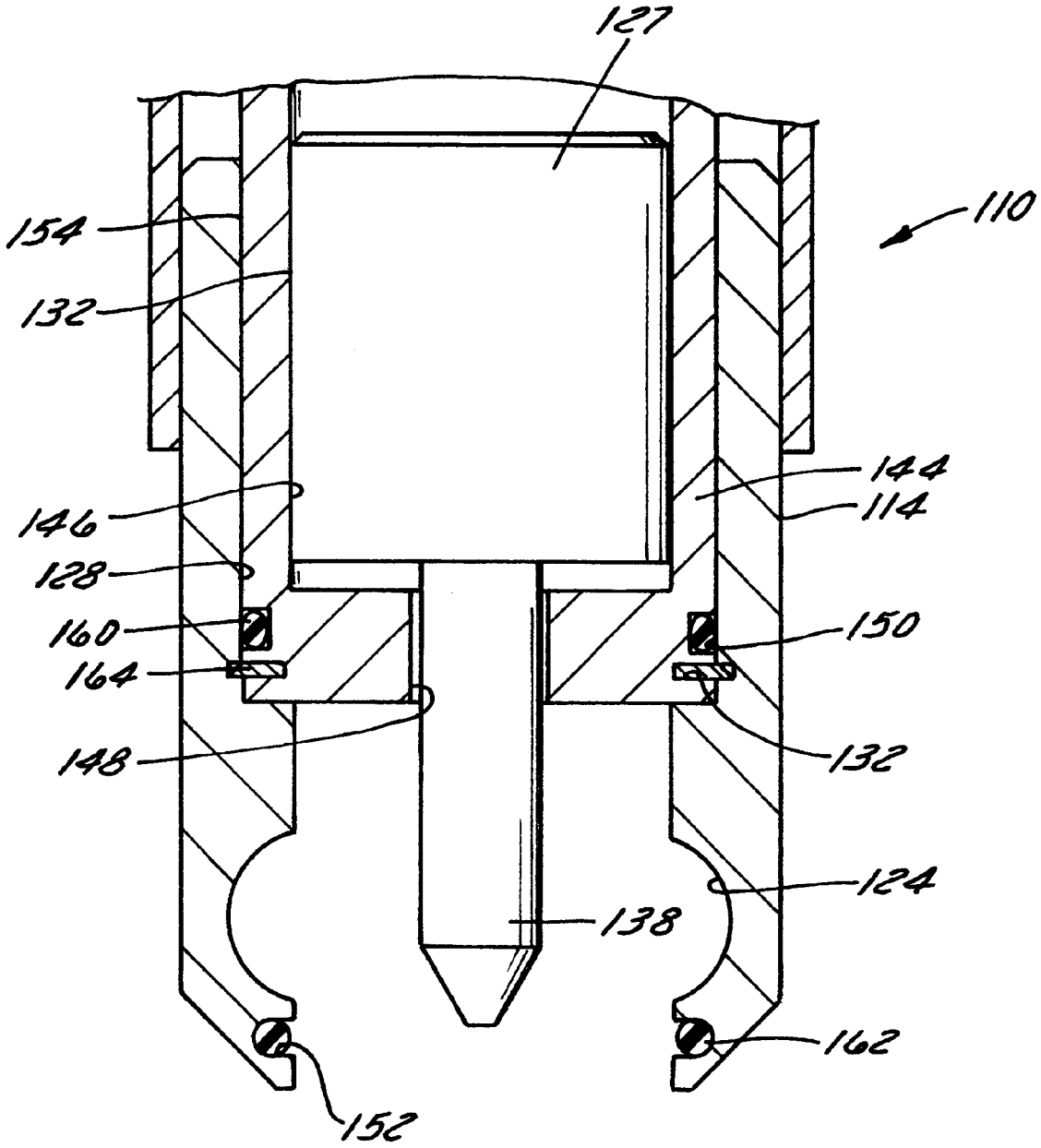
FIG. 3 is a vertical cross-sectional view of a second embodiment of the barrel lock of the present invention, which further includes sleeve and snap ring for the locking mechanism

Referring now to FIG. 3 a second embodiment of the present invention is disclosed and the numbers of all of the similar structure is the same but in the 100 series. This embodiment is generally identified by the number 110 and differs essentially in the fact that second body portion 114 is provided with sleeve structure 144 inside passageway 128. The sleeve 144 is essentially hollow and generally cylindrical, the inner surface 146 of sleeve 144 receiving in axially slideable and rotationally moveable fashion the exterior surface 132 of a keyway lock 127. The beveled point 138 of lock 127 protrudes through aperture 148 located at the axial center point of one end of sleeve 144 to slide axially therethrough.

Annular grooves 150 and 152 are provided, 150 in the outer cylindrical surface 154 of sleeve 144, and 152 in the inner cylindrical surface of portion 114. Grooves 150 and 152 are spaced axially from one another and adapted to receive O-ring gaskets 160 and 162, respectively. In between the annular grooves 156 and 156 and on the outer cylindrical surface 154 of sleeve 144 is a snap ring 164, which is biased in a radially outward fashion. A third annular groove is provided in inner surface 132 of portion 114 to receive snap ring 164 when the keyway lock 127 is axially advanced into portion 112. The snap ring 164 is beveled in cross-sectional dimension such that it can contract as keyway 127 is axially withdrawn from portion 112.

Thus it can be seen that in each embodiment of the present invention disclosed above fulfills the objects and advantages previously stated and it is intended that the structure shall be covered in the scope of the appended claims.

I claim:

1. A barrel lock assembly structure comprising:

a) a first generally cylindrical lock body portion;

b) a second generally cylindrical lock body portion disposed coaxially relative to said first lock body portion;

c) said first lock body portion being substantially solid, and said first lock body portion further having a first end section of more substantial diameter than a second end section, the first and second end sections being joined by a shoulder;

d) said second end section of the first lock body portion having a coaxial cylindrical aperture in the second end section remote from said first end section, and provided with a radial passageway containing a pair of radially disposed locking balls;

e) said second lock body portion including a hollow cylindrical passageway and a keyway locking cylinder mounted for both axial and rotational movement within said passageway;

f) said hollow cylindrical passageway of said second lock body portion including a longitudinal groove and a circumferential groove, said longitudinal and circumferential grooves meeting at one end of each, said grooves being of the same generally rectangular cross-sectional dimension;

g) a detent on an outer cylindrical surface of said keyway locking cylinder, said detent adapted to fit slideably within said grooves;

h) said second lock body portion further including a spring biasing means disposed within said hollow cylindrical passageway between said keyway locking cylinder and the end of the first body portion having the coaxial cylindrical aperture, said spring biasing means biasing said keyway locking cylinder in an axial direction away from said end;

i) said keyway locking cylinder including a pointed extension, said pointed extension extending into said coaxial cylindrical aperture and terminating in a beveled point remote from said keyway locking cylinder; and j) said hollow cylindrical passageway of said second lock body portion further including an annular groove in an inner surface of the passageway for receiving portions of the locking balls;

whereby, when said keyway locking cylinder is moved axially toward said first body portion, said pointed extension becomes inserted into said coaxial cylindrical aperture and thereby spreads said locking balls radially apart from each other and into the annular groove in the hollow cylindrical passageway of the second lock body portion, thereby locking said second body portion to said first body portion of said barrel lock assembly structure.

2. The barrel lock assembly structure of claim 1, wherein said first section of the first body portion serves as a handle and said second section of the first body portion is substantially elongated relative to said first section and adapted to pass through chain links and trailer tongues and of a smaller diameter than the second body portion.

3. The barrel lock assembly structure of claim 1, wherein the plurality of radially disposed locking ball apertures is at least two and the number of locking ball aperture openings is at least two.

4. The barrel lock assembly structure of claim 1, wherein the keyway locking cylinder includes a detent protruding radially outwardly from the outer cylindrical surface.

5. The barrel lock assembly structure of claim 4, wherein an inner surface of the hollow second body portion includes a longitudinally extending groove and a circumferential radially extending groove, said grooves being of equal size in cross-sectional dimension and complementary to said detent to receive said detent therein.

6. The barrel lock assembly structure of claim 5, wherein said keyway locking cylinder is provided with a coaxially extending cylinder section terminating in a beveled point and said spring biasing means surrounds said cylinder extension point and is compressed between a shoulder on said keyway locking cylinder and an end of the second section of the first body portion of the barrel lock assembly structure.

* * * * *